United States Patent [19]

Seragnoli

[11] 4,265,073

[45] May 5, 1981

[54] APPARATUS FOR FORMING AND OVERWRAPPING BATCHES OF PRODUCTS

[75] Inventor: Enzo Seragnoli, Bologna, Italy

[73] Assignee: G.D. S.p.A., Bologna, Italy

[21] Appl. No.: 59,778

[22] Filed: Jul. 23, 1979

[30] Foreign Application Priority Data

Sep. 14, 1978 [IT] Italy ..... 3532 A/78

[51] Int. Cl.[3] ..... B65B 35/46; B65B 11/32

[52] U.S. Cl. ..... 53/542; 53/234

[58] Field of Search ..... 53/234, 542, 533

[56] References Cited

FOREIGN PATENT DOCUMENTS 2358319 2/1978 France .

*Primary Examiner*—Horace M. Culver

*Attorney, Agent, or Firm*—Browdy & Neimark

[57] ABSTRACT

Disclosed herein is an improved apparatus for forming and overwrapping the batches of products commonly known in Italy as "sticks".

To form batches of products either flat, one on top of the other, or tip to tip along one of their narrower sides, a first intermittently rotating head provided with radial compartments for accommodating the individual products is placed at the side of a second head that rotates intermittently around an axis perpendicular to that of the first rotating head, is coupled to a wrapping mechanism and is provided with radial compartments, each suitable for accommodating one batch of products.

The said second rotating head and the wrapping mechanism are supported in such a way that they are able to move in the direction of the first head so that the second rotating head can arrive at two different stations to receive the individual products from the first rotating head. The said two stations, angularly interspaced by 90°, are located in the region of two halting positions occupied in succession by each of the compartments in the first rotating head.

6 Claims, 9 Drawing Figures

APPARATUS FOR FORMING AND OVERWRAPPING BATCHES OF PRODUCTS

BACKGROUND OF THE INVENTION

The present invention has as its subject an improved apparatus for forming and overwrapping batches of products.

DESCRIPTION OF THE PRIOR ART

Apparatus of this type, for which particularly interesting applications exist in the confectionery and the pharmaceutical fields, places side by side and in alignment, previously wrapped products fed to it in succession, and forms the products into batches, each of which made up of the required number of contiguous products.

The batches of products thus formed are then sent on to mechanism provided to overwrap them.

The final result of the said operations are the packs commonly known in Italy as "sticks".

For reasons that will become clear later on in this description, the term "products" is intended to refer to flat objects substantially parallelepiped in shape though in actual practice anything said about the said products can be extended to objects of some other shape (for example, round pastilles).

With the usual packs according to the prior art, the products forming the "sticks" are rendered contiguous to one another along the side where the dimension is the greatest, that is to say, they are placed flat one up against the other.

Recently "sticks" have been put on the market wherein the said substantially parallelepiped products are placed next to one another along one of their narrower sides, that is to say, they are placed on edge with respect to a plane perpendicular to the longitudinal dimension of the batch.

The known art envisages "sticks" of the said second type being made on machines constructed for this very purpose and studied expressly to solve the problems that are pertinent to the said second type of "sticks".

It thus ensues that to cater for producing the aforementioned two types of "sticks", it is necessary to have available two different machines, each provided with devices suitable for the purpose.

For both types of pack, the known machines comprise an intermittently rotating head provided circumferentially with compartments, each of which suitable for accommodating a batch of products of the required composition. The products, which are normally individually pre-wrapped, are fed, one at a time, to the said rotating head through the medium of pusher devices positioned in the region of a first position at which the compartments in the head halt during the intermittent rotation thereof. The batches of products stored gradually in each compartment in the rotating head are carried, through the rotation of this, to a point where an extractor device is located, at the perimeter of the rotating head, in the region of a second halting position for the compartments in the said rotating head. The conformation of the said extractor device is such that it is able to receive and restrain a batch of products, and it is movable, with respect to the rotating head, from a position at which is is located along the path described by the compartments in the rotating head, to a position external thereto, at which it is positioned along the path followed by a pusher member that attends to the taking over of the entire batch of products from the said extractor and to the transfer thereof to a wrapping mechanism.

The said wrapping mechanism is normally constituted by a rotating head provided circumferentially with compartments, each of which suitable for accommodating a batch of products. Provision is made on the perimeter of the said rotating head for folder devices that attend to the folding around each batch of products of at least one sheet of wrapping material that is suitably infed to the said wrapping mechanism.

The machines of the stated type are rather complex and the need to have available two different units set up to produce "sticks" of different types constitutes a considerable financial onus, apart from the fact that to install them takes up a notable amount of the floor space available and is absolutely detrimental to the production potential of the industry concerned.

In an endeavour to overcome the aforementioned difficulties, individual product wrapping machines have been studied, in which the not so far individually wrapped products that exit from the formation line are carried, one after the other, to an intermittently rotating disk provided circumferentially with compartments that open outwards, each of which is partially able to accommodate one product. As a result of the rotation of the said disk, the products are transported to a delivery station where a pusher device transfers them, in succession, to a rotating head equipped with grippers that extend radially with respect to the axis of rotation of the head itself.

The said head, carried in intermittent rotation, is provided circumferentially with folder devices that attend to the folding around each product, as it is held between the jaws of each gripper, of a sheet of wrapping material that is suitably infed to the rotating head.

As a result of the rotation of the said head, the products, each of which fully wrapped, arrive at a station at which they are ejected from the rotating head, where a pusher which transfers them to a batching device for them to be formed into individual "sticks" is in operation. Because of the orientation of the products at the time they leave the forming line, the wrapped products arrive at the batching device positioned in such a way as to allow them to be laid flat one on top of the other to form a "sticks" of the first above mentioned type.

In order to achieve a different product position, the machines of this type have to be equipped with a guide that is placed on the perimeter of the disk at which the products leaving the forming line arrive, and is shaped in such a way that it is able to come into contact with the part of each individual product that protrudes from the compartment in which it is partially accommodated, so as to cause the individual products to be capsized by 90° inside the corresponding compartments. As a result of the aforementioned action, the products that arrive at the said batching device are positioned in such a way as to allow them to be laid tip to tip, one on top of the other, along one of their narrower sides to form a "sticks" of the second above mentioned type.

To then subsequently be able to overwrap the formed batches of products, it is necessary to have available, downstream with respect to the said batching device, various wrapping devices of a type corresponding to the description given above, which can be adapted on each occasion to suit the type of "stick" it is washed to produce.

The machines of this type require complicated adjustments to set up the guides with which it is possible to achieve the desired capsizing of the products, and to the devices that enable the different types of "sticks" to be wrapped.

In addition to the foregoing, the necessary capsizing of the products causes them to be arranged differently in between the grippers of the rotating head that is part of the wrapping mechanism. The said different arrangement makes it necessary to suitably adjust or even change over the said grippers, as well as to correspondingly set the folder devices which fold the sheet of wrapping material around the products, thereby wasting a considerable amount of time to the detriment of production times and costs.

SUMMARY OF THE INVENTION

The present invention sets out to overcome the obvious difficulties of a technical and financial nature that exist with the known art and, in fact, has as its object the construction of an apparatus that is able to place the products supplied to it, side by side, in either one of the two previously defined arrangements, and more precisely, an apparatus that can be adapted to suit the requirements, for the production of batches of products of one or the other type, through operations of the utmost simplicity which call for no adjustment of alteration to the items of equipment belonging to the machine that supplies the products to the said apparatus.

This and other objects too have all been attained with the apparatus forming the subject of the present invention, comprising: a first rotating head for infeeding the individual products, movable intermittently around its own axis and provided with equidistant radial compartments in which the individual products are accommodated, the arrangement of the said compartments being such that each one adopts, at successive times and during the halting times of the rotating head, two waiting positions that are interspaced angularly by 90°; a second intermittently rotating head for forming the batches of products, whose axis of rotation is perpendicular to the axis of the first rotating head, provided with equidistant radial compartments so dimensioned that each can accommodate a desired batch of products; pusher devices positioned between the first and the second rotating head in order to withdraw the individual products from the first rotating head and to transfer them to the said second rotating head; and a mechanism for wrapping the batches of products, comprising a head that rotates intermittently around an axis parallel to the axis of rotation of the second rotating head and is provided with equidistant radial compartments so dimensioned that each can accept a batch of products withdrawn from the second rotating head by ejector and pusher devices located between the said second rotating head and the said wrapping mechanism, essential features of the apparatus being that the said second rotating head and the said wrapping mechanism are supported by a casing that rests on the bed plate and is able to slide, guided with respect thereto, alternately in the direction of the first rotating head, following a path such that the second rotating head can be carried, at successive times, in the region of two stations for the transfer of the individual products from the first rotating head to the second rotating head, placed at points corresponding to the said two waiting positions for each of the 90° angularly interspaced compartments in the first rotating head, it being possible to vary the sliding movement of the said support casing with respect to the bed plate through a setting device connected to the latter, and through locking means that have an effect on the slide guides of the said support casing, to place this stably with the second rotating head in the region of the said transfer stations.

Thanks to this particular method and through a simple operation for positioning the second rotating head with respect to the first rotating head, the withdrawal is achieved of the individual products from the latter at two different stations that are angularly interspaced by 90°. In this way the products withdrawn gradually, at different times, at the aforementioned two stations are turned over by 90° with respect to one another so that the first ones are flat side by side, while the second ones are placed on edge with respect to a plane perpendicular to the longitudinal dimension of the batch.

The use of two different machines to produce the above mentioned two types of "sticks" is thus dispensed with, as is also any adjustment to the operating devices placed upstream of the said apparatus.

BRIEF DESCRIPTION OF THE DRAWINGS

Further characteristics and advantages will emerge more obviously from the following detailed description of a preferred form of embodiment for the improved apparatus according to the invention, illustrated purely as an unlimited example on the accompanying drawings, in which.

DESCRIPTION OF THE PREFERRED EMBODIMENTS

Figure 1:
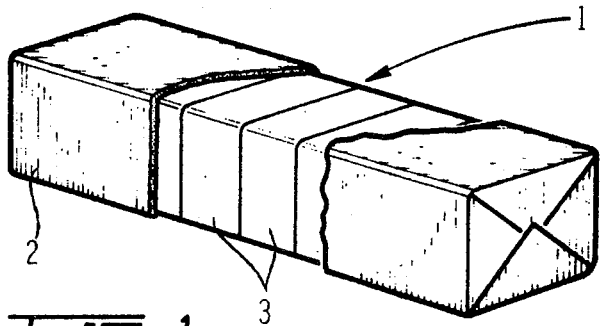
FIG. 1 shows, in a perspective view, a first type of "sticks" that can be produced with the apparatus in question, wherein the individual products are flat, one on top of the other.

In FIG. 1 and shown globally at 1 there is a batch of products, hereinafter defined of the first type, covered with a sheet of overwrapping material 2 and consisting of products 3, substantially of parallelepiped shape, placed one at the side of the other along their wider side, that is to say, on the flat.

Figure 2:
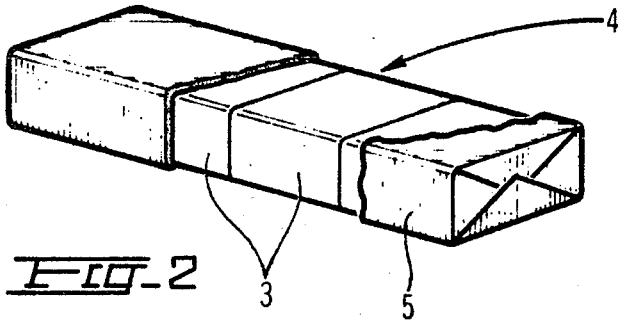
FIG. 2 shows, in a perspective view, a second type of "stick" that can be produced with the apparatus in question, wherein the individual products are placed tip to tip along one of their narrower sides.

In FIG. 2 and shown globally at 4 there is another batch of products, hereinafter defined of the second type, covered with a sheet of overwrapping material 5, in which the said products 3 are placed side by side along one of their narrower sides, that is to say, on edge with respect to a plane perpendicular to the longitudinal dimension of the batch.

Figure 3:
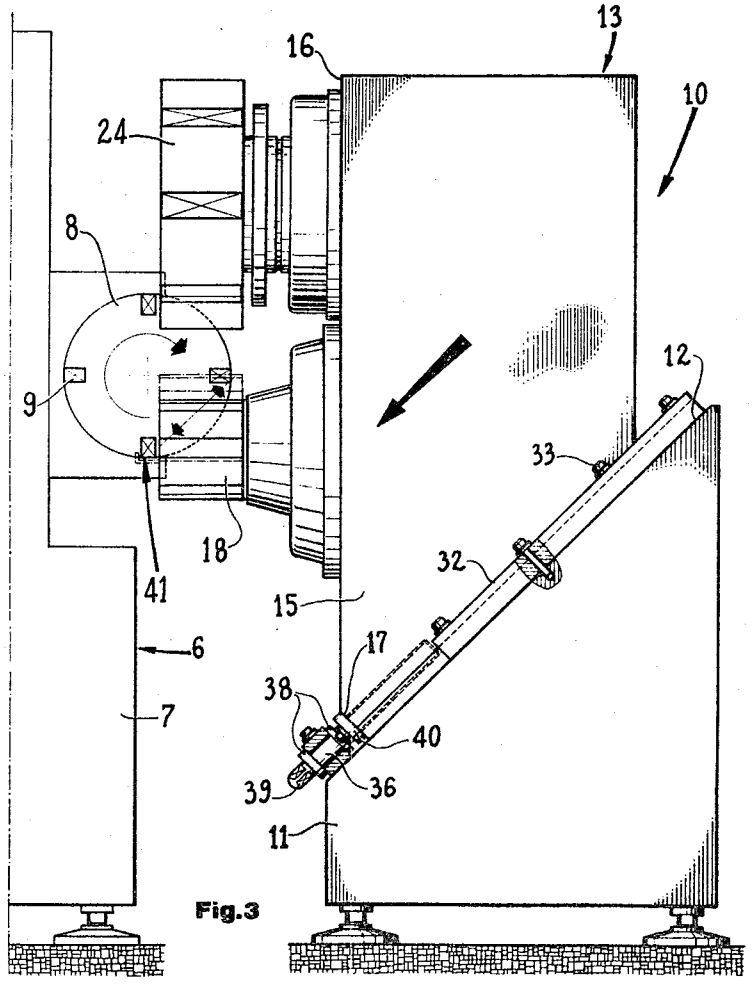
FIG. 3 shows, diagrammatically, the apparatus in question, in a lateral view and in a first operating condition for producing "sticks" of the type depicted in FIG. 1.

With reference to FIG. 3, for the apparatus in question the use is envisaged of a wrapping machine for individual products 3, shown globally at 6, the bed plate of which is delimitated at the front (when looking at the aforementioned figure) by a vertical wall 7. Belonging to the said machine there is a wheel or head 8 that rotates intermittently around an axis horizontal and perpendicular to the wall 7.

The head 8 is circumferentially provided with four radial compartments 9 that open outwards and are equidistant, designed to accommodate the products 3 placed on edge with respect to the axis of rotation of the said head.

The head 8 turns in a clockwise direction, with rotations of 90° per intermittent movement, and it can be adjusted on its axis so that at each halt thereof two diametrically opposed compartments 9 are placed in horizontal and vertical alignment, respectively.

With the apparatus in question the use is envisaged, furthermore, of a machine for forming and overwrapping the batches of products 3 and this is shown at 10 in FIGS. 3, 4, 5 and 6.

The said machine 10 comprises a bed plate 11 which is delimitated at the top by a surface 12 that slopes at substantially 45° with respect to the horizontal. The way in which the machine 10 is arranged on its support plane is such that the said surface 12, turned towards the machine 6, is parallel to the axis of rotation of the head 8. Mounted on the surface 12 of the bed plate 11, with the interposition of adjustment means described in detail below, there is a casing 13 delimitated laterally (when looking at FIG. 4) by the vertical walls 14 and 15 parallel to the wall 7, and on the opposite side to the machine 6 by a vertical wall 16, perpendicular to the walls 14 and 15, the lower extremity of which is provided with a bevel 17 perpendicular to the surface 12. The wall 16 supports, cantilever fashion, a head 18 that is defined the head for forming the batches of products and is intermittently rotating around a horizontal axis perpendicular to the axis of the rotating head 8.

The said head 18 is provided with radial compartments 19 to accommodate the batches made up of the products 3 which are infed to it, one at a time, from the rotating head 8 in the region of a transfer station at which the compartments of the two rotating heads 8 and 18 halt synchronously in succession.

Provision is made at the said station (see also FIG. 7) for a first pusher 20 parallel to the axis of the rotating head 8, a second pusher 21 parallel to the axis of the rotating head 18, and a horizontal plate 22 provided with guide borders 23, which is destined to sustain and guide the products during the transfer operation from the rotating head 8 to the rotating head 18.

Above the latter mentioned head, the casing 13 supports a wrapping mechanism comprising a cantilever fashion mounted rotating wrapping head 24 on an axis parallel to that of the rotating head 18, which is provided with radial compartments 25 inside which the overwrapping of the batches forthcoming from the rotating head 18 is effected in a known manner not described herein.

Figure 4:
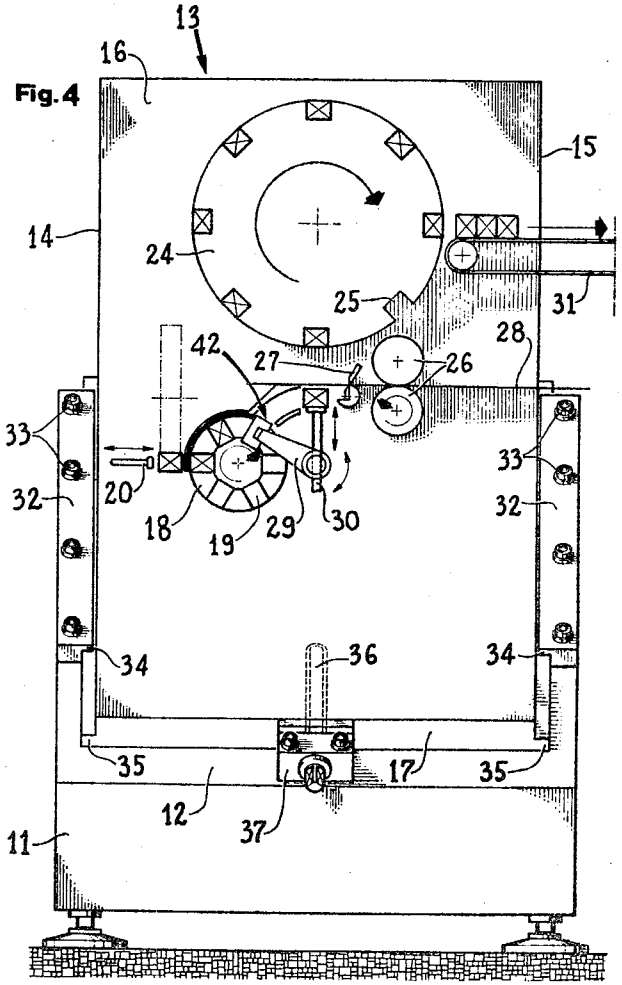
FIG. 4 shows, diagrammatically in a front view, the apparatus illustrated in FIG. 3.

For this purpose, with particular reference to FIG. 4, at an intermediate level between the two heads 18 and 24, rollers are provided for infeeding and cutting into pieces a web of wrapping material 28.

At 29 there is an arm or ejector that oscillates around an axis perpendicular to the wall 16 and is provided to extract the batches of products 3 from a compartment 19 in the rotating head 18 and to transfer them to a vertical lifting member or pusher 30.

The latter attends to the individual insertion of the said batches, along with a cutting of wrapping material, into a compartment 25 in the rotating head 24.

A belt conveyor 31 carries the overwrapped batches ("sticks") arriving from the wrappping head 24.

A detailed description will now be given of the adjustments means to which prior reference has been made.

These comprise guiding and locking means constituted by two bars 32 that are parallel with each other and are secured to the righthand extremity and to the lefthand extremity (when looking at FIG. 4) of the sloping surface 12 by means of the screws 33.

The facing sides of the two bars 32, provided at the top and over the full extension thereof with the projecting edges 34 grip, with a pressure that can be set by means of the screws 33, the corresponding projecting edges 35 with which the lower extremity of the walls 14 and 15 is provided.

Belonging to the said adjustment means there is an operating device constituted by a partially threaded rod 36 which is parallel to the bars 32 and runs through a parallelepiped block 37 fixed, in an equidistant position between the two bars 32, in the region of the lower extremity of the surface 12.

The rod 36 is mounted inside the block 37 in such a way that it is rotatable around its own axis and due to the presence of two collar rings 38, it is locked in an axial direction with respect to the said block.

The lower extremity of the rod 36, protruding from the block 37, is provided with a head 39 of square section, while the threaded portion thereof is screwed, with the interposition of a plate 20, into the casing 13, in the region of the bevel 17 in the wall 16.

Assuming the apparatus according to the invention to initially be set up to form "sticks" of the conventional type depicted in FIG. 1, the casing 13 adopts, with respect to the bed plate 11, the position illustrated in FIGS. 3 and 4, which is also defined (when looking at FIG. 3) the left hand limit position.

When in the said state, the threaded portion of the rod 36 is fully inserted into the casing 13.

Figure 7:
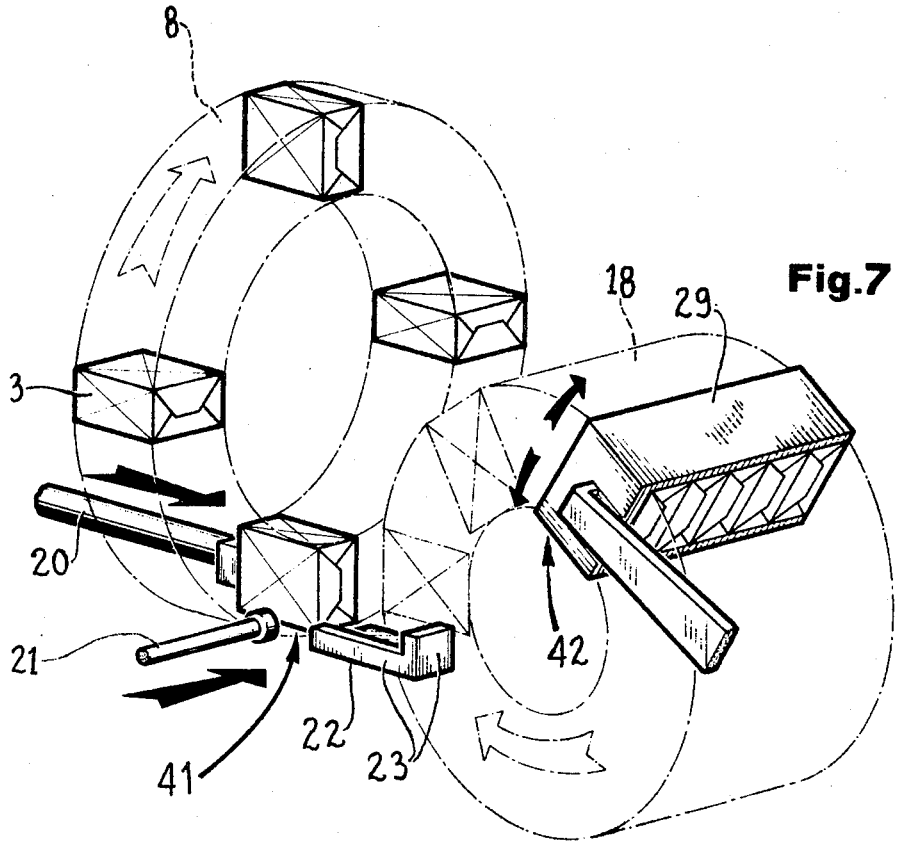
FIG. 7 shows, diagrammatically in a perspective view and on an enlarged scale with respect to FIGS. 3 and 4, the details relating to the first and second rotating head and to the devices for ejecting and transferring the individual products from the said first rotating head to the said second rotating head, as well as to the device for withdrawing a formed batch of products from the said second rotating head.

In the said condition, the arrangement of the rotating head 8 with respect to that of the rotating head 18 is as shown in FIGS. 3 and 7, and the aforementioned transfer station at which the pushers 20 and 21 operate adopts the position shown at 41 in FIG. 3.

Let the two machines 6 and 10 now be considered to be in operation.

The forming of the batches 1 of the products 3 takes place under the action of the said means in the way briefly described below.

At a point corresponding to position 41, the products come to a halt inside the corresponding compartments 9 with which the rotating head 8 is provided, placed on edge with respect to the horizontal.

Their transfer to the rotating head 18 occurs in two separate stages along a horizontal sliding surface.

The pusher 20, see FIGS. 4 and 7, movable parallel to the axis of the rotating head 8, expels a product 3 from the stationary compartment 9 and moves it onto the plate 22.

The second pusher 21, horizontal and movable parallel to the axis of the rotating head 18, then attends to transferring the product 3, transversely to the major dimension thereof, from the plate 22 into a compartment 19 in the rotating head 18, which is in the stationary condition.

The said transfer operations are repeated on the products as they are gradually infed in the said position 41 from the rotating head 8, until the said compartment 19 has been fully filled, that is to say, until a batch 1 made up of products 3 placed on edge has been formed.

The rotating head 18, turning intermittently around its own axis, then transfers the batch 1 to a withdrawal position shown at 42 in FIGS. 4 and 7, at which the said batch is extracted from the compartment 19 under the action of an oscillating arm or ejector device 29. The vertical lifting member 30 then takes possession of the batch 1 and inserts it, together with a cutting of wrapping material, into a compartment 23 in the rotating wrapping head 24 which, in a known fashion that is not shown, attends to the creation of the actual "stick" (see FIG. 1).

Figure 6:
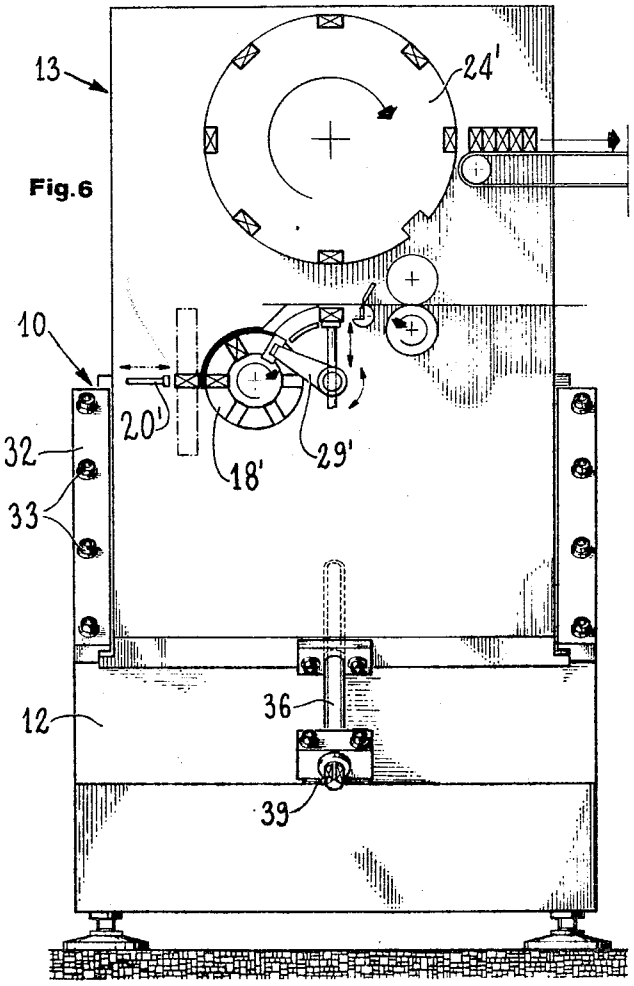
FIG. 6 shows, diagrammatically in a front view, the apparatus illustrated in FIG. 5.
Figure 5:
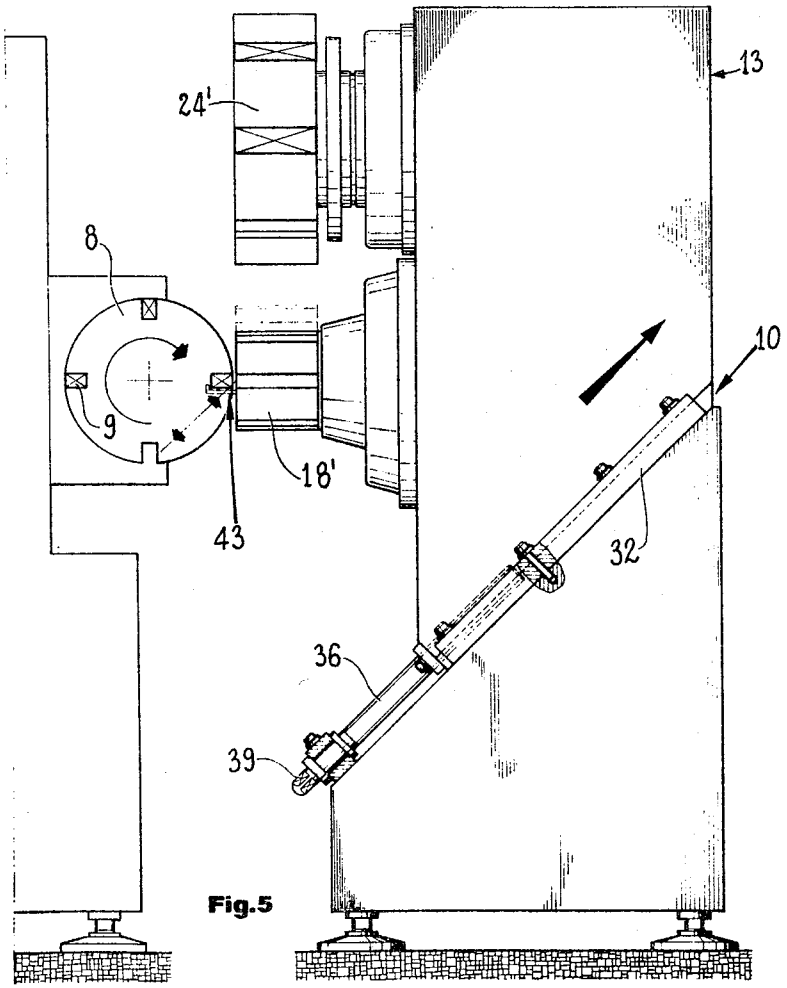
FIG. 5 shows, diagrammatically, the apparatus in question, in a lateral view and in a second operating condition for producing "sticks" of the type depicted in FIG. 1.
Figure 8:
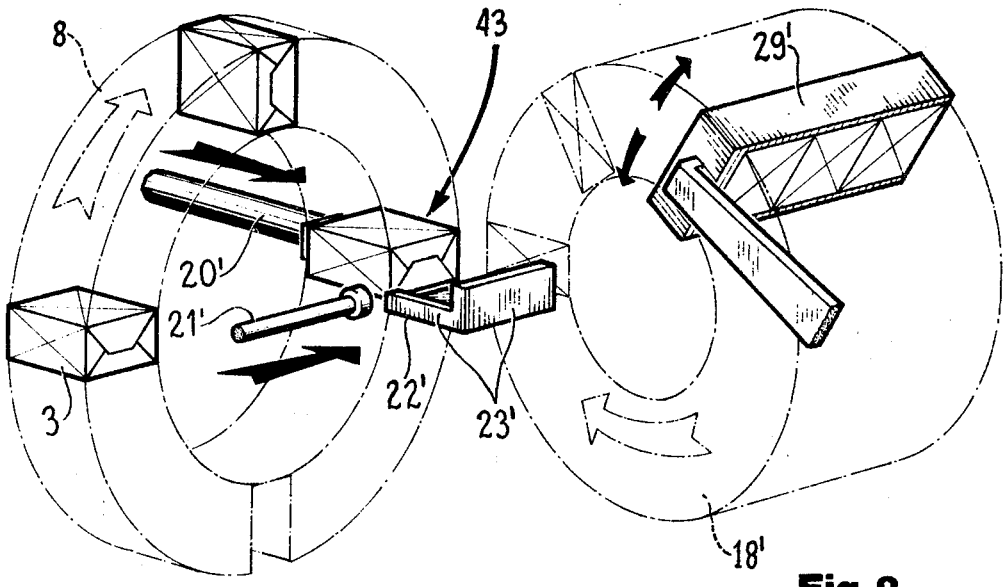
FIG. 8 shows, diagrammatically in a perspective view and on an enlarged scale with respect to FIGS. 5 and 6, the same details depicted in FIG. 7.

Let the case now be considered in which, after a period of operation under the conditions described, it is wished to set the apparatus in question up to produce "sticks" of the type depicted in FIG. 2 wherein the products are placed in contact with one another along one of their narrower sides (see FIGS. 5, 6 and 8).

In order to do this, all that has to be done is to firstly change over certain mechanical parts designed to suit the size and shape of the batches of the first type.

For this reason, for example, the two heads 18 and 24 and the oscillating arm 29 need to be replaced with the heads 18' and 24' and with the oscillating arm 29', respectively, designed to handle batches of the second type. Then after having previously loosened the screws 33 of the bars 32, a suitable tool is used on the square section head 39 of the rod 36 in order to rotate the latter around its own axis.

Through the worm that runs between the rod 36 and the casing 13, the latter slides along the sloping surface 12 from the lefthand furthermost position shown in FIG. 3 to the righthand furthermost position shown in FIG. 5 where it is locked by tightening the screws 33 onto the bars 32. As a result of this, a variation is made to the arrangement of the rotating head 8 that infeeds the products 3 with respect to the rotating head 18' that forms the batches 4 of the products 3 and, as shown in FIGS. 5 and 8, the product transfer station adopts a new position 43 which is advanced, in the direction of the rotation of the rotating head, by 90° compared to the transfer position 41. It is obvious that in the said position 43, the products 3 are capsized inside their corresponding compartments 9 by 90° with respect to the products occupying position 41, that is to say, that they halt in the said position placed on edge with respect to the horizontal support surface.

The pusher 20' parallel to the axis of the rotating head 8, and the pusher 21' parallel to the axis of the rotating head 18', operate in the region of the position 43, and a horizontal plate 22' fitted with guide borders 23' is provided.

The said pushers 20' and 21' can be considered to be constituted by the aforementioned pushers 20 and 21, respectively, moved in a way integral with the casing 13 along with the respective operating devices that are not depicted in the accompanying drawings.

The forming of the batches 4 depicted in FIG. 2 occurs under the action of the aforementioned means, in accordance with the methods described previously in respect of the batches 1 depicted in FIG. 1. More precisely, the pusher 20' expels, with the rotating head 8 at a halt, a product 3 from the relevant compartment 9 and places it flat onto the plate 22' whose function is identical to that of the plate 22.

The second pusher 21' then attends to transferring the product 3 from the said plate 22' to inside a compartment in the rotating head 18' which is at a standstill.

The said operations are repeated until a batch has been formed and, on account of what has been said earlier on, the products 3 touch against one another along one of their narrower sides.

Figure 9:
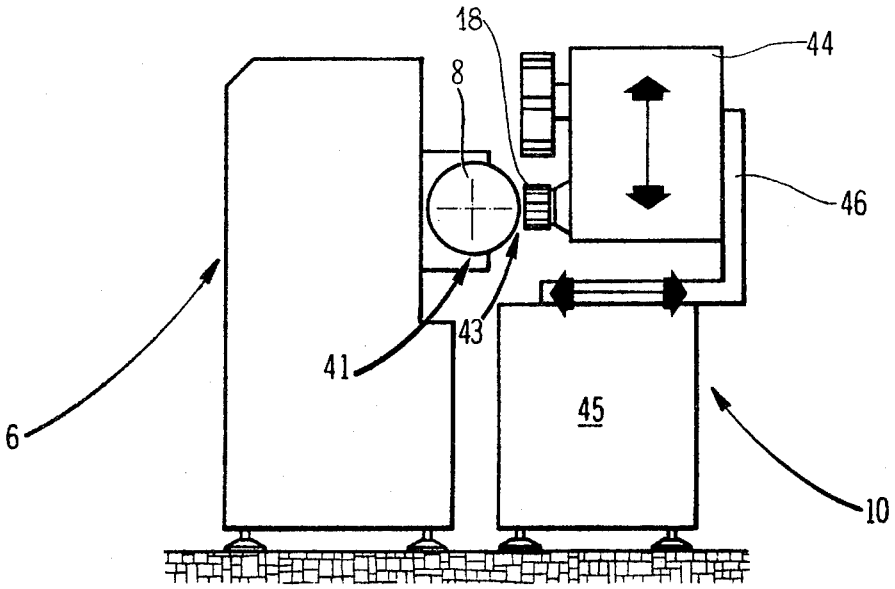
FIG. 9 shows, in a lateral view, a second form of embodiment for the apparatus in question.

In FIG. 9 a variant is shown for the apparatus forming the subject of the present invention.

With this particular form of embodiment, the machine 10 for forming and overwrapping the batches of products is constituted by a casing 44 and by a bed plate 45, both substantially parallelepiped in shape.

The changeover of the head 18 that forms the batches from position 41 to position 43 is, in this latter instance, effected in two separate movements and, to be more precise, it takes place along the vertical and horizontal components of the imaginary line that links the said two positions.

In actual practice, the casing 44 is displaced along the vertical plane and the horizontal plane of a guide member 46 that is fashioned in the form of a bracket and is secured to the bed plate 45.

The operating means, not depicted in FIG. 9, are made up of two separate units, of the type, for example, of the threaded rod 36 to which more ample reference has previously been made, which extends parallel to the aforementioned movement directions.

With this latter form of embodiment it is possible to adjust the rotating head 18 that forms the batches very accurately with respect to the rotating head 8, and it has shown itself to be particularly advantageous when matching operations have to be carried out on the apparatus because of variations in the dimensions or in the shape of the products infed from the machine 6.

What is claimed is:

1. In an improved apparatus for forming and overwrapping batches of products of flat shape which has a first rotating head for infeeding individual products, movable intermittently around its own axis and provided with equidistant radial compartments in which individual products are accommodated, the compartments being so positioned that each one adopts, at successive times and during halting of the first rotating head, two positions which are interspaced angularly by 90°; a second rotating head for forming batches of the individual products, whose axis of rotation is perpendicular to the axis of the first rotating head and which is provided with equidistant radial compartments so dimensioned that each can accommodate a desired batch of the individual products; a mechanism for wrapping the batches, which includes a further head that rotates intermittently around an axis parallel to the axis of rotation of the second rotating head and is provided with equidistant radial compartments so dimensioned that each can accept a batch of products withdrawn from the second rotating head; ejector and pusher devices located between the second rotating head and the wrapping mechanism for transferring batches of products from the second rotating head to the wrapping mechanism; an improvement comprising a bed plate; a slideable support casing resting on said bed plate and slideable with respect thereto, said second rotating head and said wrapping mechanism being supported by said casing which rests on said bed plate; slide guides of said support casing for guiding said plate to allow it to slide alternately in direction of said first rotating head, along a path such that said second rotating head is positioned at successive times, in vicinity of two transfer stations for transfer of individual products from said first rotating head to said second rotating head, at points corresponding to two waiting positions for each of said 90° angularly interspaced compartments in said first rotating head; at least one pair of pusher devices in vicinity of said first rotating head and between this and said second rotating head, said pair of pusher devices being movable parallel to the axes of said first rotating head and of said second rotating head, respectively, to withdraw individual products from said first rotating head and to transfer them to said second rotating head; means for adjusting the sliding movement of said support casing with respect to said bed plate on which the former rests; a setting device connected to said means for adjusting to stably position said support casing, with said second rotating head, in vicinity of said transfer stations, said setting device including locking means which act on said slide guides of said said support casing.

2. An improved apparatus according to claim 1, wherein said first rotating head and said second rotating head are mounted on horizontal axes and said first rotating head is set on its axis at points corresponding respectively to individuals ones of said two transfer stations, whereby products accommodated inside compartments positioned in the vicinity of said stations can be placed on edge and flat, respectively, with respect to horizontal.

3. An improved apparatus according to claim 1 or claim 2, wherein said bed plate is delimitated at its top by a support surface over which said support casing slides, said support surface sloping with respect to horizontal and being substantially parallel to an imaginary line which links said two transfer stations for the transfer of products from said first rotating head to said second rotating head, and to the axis of rotation of said first rotating head.

4. An improved apparatus according to claim 1 or claim 2, wherein said slide guides of said support casing are constituted by two bars mounted on said support casing and a sliding surface that delimitates said bed plate at an upper portion thereof, said bars extending substantially parallel to an imaginary line which links the two positions for transfer of individual products from said first to said second rotating head, and including means for locking said first and second heads to said surface in position where two edges protrude laterally from said support casing.

5. An improved apparatus according to claim 1 or claim 2, wherein said means for adjusting the sliding movement of said support casing with respect to said bed plate comprises a threaded rod parallel to said slide guides, connected axially to said bed plate and free to rotate with respect thereto, this engaging with said support casing through a worm.

6. An improved apparatus according to claim 1 or claim 2, including a member fashioned as a bracket, and wherein said slide guides extend along two planes of said bracket, said bracket being integral with said bed plate, the said planes being parallel to the axis of said first rotating head and directed along vertical and horizontal components of an imaginary line which links said two transfer stations for transfer of individual products from said first to said second rotating head.

* * * * *